United States Patent [19]

McQueary

[11] 3,956,556

[45] *May 11, 1976

[54] ARTICLE FOR CONDITIONING FABRICS IN A CLOTHES DRYER

[75] Inventor: Agnes R. McQueary, Cincinnati, Ohio

[73] Assignee: The Procter & Gamble Company, Cincinnati, Ohio

[ * ] Notice: The portion of the term of this patent subsequent to Mar. 4, 1992, has been disclaimed.

[22] Filed: Apr. 3, 1973

[21] Appl. No.: 347,606

[52] U.S. Cl. ..... 428/131; 427/242; 428/136; 428/137; 428/906

[51] Int. Cl.[2] ..... B32B 3/10

[58] Field of Search ..... 117/139.5 CQ, 139.5 F, 117/109, 120, 140 R, 154; 252/91, 93, 8.8; 428/131, 136, 137, 906; 427/242

[56] References Cited

UNITED STATES PATENTS

| | | | |
|---|---|---|---|
| 2,112,963 | 4/1938 | Jones | 15/208 |
| 2,560,649 | 7/1951 | Hornaday | 252/90 X |
| 2,817,596 | 12/1957 | Schur | 117/4 |
| 3,112,219 | 11/1963 | Politzer et al. | 117/98 F |
| 3,442,692 | 5/1969 | Gaiser | 117/120 |
| 3,686,025 | 8/1972 | Morton | 117/140 R |

*Primary Examiner*—Harry J. Gwinnell
*Attorney, Agent, or Firm*—Louis G. Xiarhos; George W. Allen; Richard C. Witte

[57] ABSTRACT

A fabric-conditioning article adapted to the conditioning of fabrics in a laundry dryer comprising a flexible substrate carrying a conditioning agent removable to fabrics by contact therewith in a laundry dryer and having perforations sufficient in size and number as to permit at least about 75% of the normal volume of air flow through said dryer when said article is used therein.

5 Claims, No Drawings

ARTICLE FOR CONDITIONING FABRICS IN A CLOTHES DRYER

BACKGROUND OF THE INVENTION

This invention relates to an article useful in the conditioning of fabrics in a laundry dryer. More particularly, it relates to an improved fabric-conditioning article in the form of a flexible substrate carrying a conditioning agent removable to fabrics in a laundry dryer.

The employment of fabric-conditioning articles to impart softening, antistatic, lubricating, bacteriostatic mildew-proofing or other desirable fabric-conditioning effects in a laundry dryer has been described in the art. For example, U.S. Pat. No. 3,442,692 to Gaiser (May 6, 1969) describes the conditioning of fabrics in a laundry dryer by cotumbling the fabrics with a flexible substrate carrying a conditioning agent. The conditioning agent is removed to the tumbling fabrics to provide a fabric conditioning which otherwise might only inconveniently be effected by treatment, for example, during the rinsing cycle of a laundering operation. Similarly, U.S. Pat. No. 3,686,025, issued Aug. 22, 1972 to Morton, describes an article for conditioning fabrics in a laundry dryer. The article comprises an absorptive substrate impregnated with a fabric-softening agent for the provision of fabric softening effects with minimal staining tendencies.

While the fabric-conditioning articles of the prior art are effective to provide a variety of fabric surface modifications, such as fabric softening, their effectiveness can be diminished where they are not structurally compatible with the various types of automatic laundry dryers available in the marketplace. There may be a tendency, for example, for such articles to become physically immobilized in certain types of laundry dryers by sticking or otherwise attaching to the exhaust outlet means of the dryer or to a lint filter or trap by the drawing effect of exhausting air and water vapor. The passage of air into the area within which the tumbling clothes are confined and out of the dryer, as by passage through a perforated rear wall or door, creates a drawing effect capable of holding a fabric-conditioning article in such a manner as to impede the flow of air out of the laundry dryer.

The tendency of a fabric-conditioning article to restrict air flow is most noticeable where the article is employed in a fabric load comprised of only a few tumbling fabrics. A load of 2 lbs. dry weight or less is an example of such a load. Normally, restricted air flow will result in slow or inefficient drying. If air blockage is sufficient, dangerous build-up of heat in the dryer can occur and should the temperature in the heater housing exceed a preset limit, for example, 275°F, the high-limit thermostat of the dryer will open and thereby interrupt the flow of current to the heater or gas to the burner. In some models, the high-limit thermostat will also shut off power to the drive motor requiring that the dryer be restarted. The high-limit thermostat is closed in normal operation and any situation calling this device into operation is desirably avoided.

It is an object of the present invention to provide a fabric-conditioning article compatible with laundry dryers.

It is another object of the present invention to provide a fabric-conditioning article capable of conditioning fabrics in a laundry dryer without adversely affecting air flow.

A further object is to provide an article for conditioning fabrics in a laundry dryer and which prevents undesirable build-up of heat.

Other objects will become apparent from the description appearing hereinafter.

SUMMARY OF THE INVENTION

These and other objects can be achieved by the present invention which resides in a fabric-conditioning article especially adapted to the conditioning of fabrics by tumbling of the fabrics in a laundry dryer and which is structurally compatible with laundry dryers as to minimize air-flow interruption. Summarizing the invention, it comprises a fabric-conditioning article comprising a web substrate carrying a fabric-conditioning agent removable to fabrics by contact therewith in a laundry dryer and having perforations sufficient in size and number as to permit forced air penetration. In its method aspect, the invention provides, in the conditioning of fabrics by addition of conditioning agents thereto, the step of commingling the fabrics to be conditioned with a substrate carrying a conditioning agent removable to the fabrics and having perforations, thereby to reduce the hindering or restrictive effect of the article upon the exhaust of air from the dryer.

The fabric-conditioning article comprises a flexible web such as paper or cloth carrying a conditioning agent such as a fabric softening agent and is normally made up into a tubular roll or individual sheets. A desired length of the treated web is torn off the roll or a sheet removed from its package and placed into the clothes dryer wherein the fabrics to be treated have been loaded. The dryer is then operated in customary fashion, and fabric conditioning occurs as the fabrics directly contact the treated web, whereby the conditioning agent is transferred from the web substrate to the fabric. Particularly when small fabric loads are tumbled and the probability of a tumbling fabric-conditioning article of making repeated or prolonged contact with a laundry dryer exhaust outlet is enhanced, the perforations or openings in the treated web advantageously minimize the interruption of air flow through the dryer. This is effected by passage of air through perforations or by crumpling or puckering of the perforated web in such a manner as to permit minimal blockage of the air exhaust outlet and/or ready detachment therefrom by collision with tumbling fabrics.

Various objects, details, constructions, operations, uses, advantages and modifications of the invention will be apparent from the following description.

DETAILED DESCRIPTION OF THE INVENTION

The conditioning articles of the invention comprise a web substrate carrying conditioning agent which is transferred to tumbling articles of laundry coming into contact therewith in a laundry dryer and have perforations to thereby permit passage of air therethrough. If the article is placed into a form-retaining relationship to a perforated door or wall exhaust outlet, for example, the passage of air through the perforated article permits a reduction of the vacuum or drawing effect of the circulating air and allows the tumbling load to more easily knock the article off the exhaust outlet with the result that contact between the article and the exhaust outlet is minimized and contact between the article and the tumbling fabrics is maximized.

The fabric conditioning articles of the invention comprise a flexible web substrate carrying a conditioning agent. Suitable substrate materials for carrying the conditioning agent include a variety of natural or synthetic substrate materials. Suitable substrates are those which have the ability to retain a fabric-conditioning agent in a form which is releaseable to fabrics tumbled therewith and which have a resistance to shredding or other tearing failures when tumbled with damp clothes in a dryer. Examples of suitable substrates include paper towelling, swatches of woven and non-woven cloth, papers, sponges, plastics and felts. Fibrous materials can be natural or synthetic but are preferably cellulosic. Foam plastic web materials, such as the polyurethanes, can also be employed.

In one embodiment of the invention, a substrate which is relatively impermeable to the fabric-conditioning agent is employed so as to dispose the fabric-conditioning agent onto the substrate as a discrete surface coating. Wet strength papers, regenerated cellulose, rayon, nylon, polyester, polyacrylonitrile, polyolefin and other synthetic woven or non-woven fibrous materials are suitable for this purpose. Wet strength paper is suitably employed and can be treated with a waterproofing or sizing material such as a thermosetting resin, starch or other impregnant, having the effect of reducing water absorption by fibrous cellulosic products and allowing the formation of a coating of conditioning agent. Waxy papers which carry coatings or impregnations of paraffin or microcrystalline or synthetic wax can be used, e.g., "butcher paper" or dry waxed paper, to the extent of reducing moisture absorption but permitting adherent coating of the paper with conditioning agent. Wet strength papers, such as Kraft or bond paper, can be suitably employed.

Preferred articles of the invention include those formed from a substrate having an absorption capacity in relation, for example, to fabric softening agents as to provide an impregnated article capable of controllably releasing the softening agent to treated fabrics. Improved softness or feel of the treated fabrics is provided without overdosing or localized concentration of softener in the form of spots or stains. Suitable absorbent substrate materials are described in considerable detail in U.S. Pat. No. 3,686,025, issued Aug. 22, 1972 to Morton. Preferred absorbent substrates are cellulosic materials such as multi-ply paper towel and non-woven cloth substrates. Preferred paper towel materials and their method of manufacture can be found in U.S. Pat. No. 3,414,459, issued Dec. 3, 1968 to Wells, and incorporated herein by reference. Preferred non-woven cloth substrates can be generally defined as adhesively-bonded fibrous or filamentous products having a web structure, in which the fibers or filaments are distributed haphazardly, as in the "wet lay" processes, or with a degree of orientation, as in the "carding" process. Such substrates exhibit desirable strength in all directions and are resistant to shredding or tearing failures when tumbled with damp fabrics. The fibers or filaments of such non-woven cloth substrates can be natural (e.g., wool, silk, jute, hemp, cotton, linen, sisal or ramie) or synthetic (e.g., rayon, cellulose ester, polyvinyl derivatives, polyolefins, polyamides or polyesters) and bonded together with a polymeric binder resin such as polyvinyl acetate. Such substrates will normally have a void volume of from about 40% to about 90%, to provide desirable absorbent properties.

The conditioning agents employed herein include any of a variety of agents employed generally in textile treating operations. Accordingly, fabric softening, antistatic, anti-meldew, germicidal, mothproofing and anti-wrinkling agents, perfumes and the like can be employed. The most universal preference, however, is for agents which act to soften fabrics or otherwise improve their feel or hand. Softening agents which also have antistatic properties and which reduce static charge or fabric cling are especially preferred.

Typically, the fabric softening agents that can be employed are compounds having a relatively-long hydrocarbon group serving to provide hydrophobicity or lubricity. Among such groups are alkyl groups containing 8 or more carbon atoms and preferably from 12 to 22 carbon atoms. Suitable fabric softening agents include cationic, anionic, nonionic, or zwitterionic compounds. Cationic fabric-softening agents include the cationic nitrogen-containing compounds such as quaternary ammonium compounds and amines which have one or two straight-chain organic groups of at least 8 carbon atoms. Preferably, they have one or two such groups of from 12 to 22 carbon atoms. Preferred cation-active softener compounds include the quaternary ammonium softener compounds corresponding to the formula

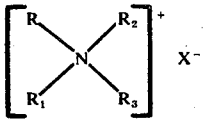

wherein R is hydrogen or an aliphatic group of from 12 to 22 carbons; $R_1$ is an aliphatic group having from 12 to 22 carbon atoms; $R_2$ and $R_3$ are each alkyl groups of from 1 to 3 carbon atoms; and X is an anion selected from halogen, acetate phosphate, nitrite and methyl sulfate radicals.

Because of their excellent softening efficacy and ready availability, preferred cationic softener compounds of the invention are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein R and $R_1$ have predominantly from 16 to 18 carbon atoms. The term "coconut" refers to fatty acid groups from coconut oil fatty acids. The coconut-alkyl R and $R_1$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride, dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl diethyl ammonium chloride; dihexadecyl dimethyl ammonium acetate; ditallow dipropyl ammonium phosphate; ditallow dimethyl ammonium nitrite; di(coconut-alkyl) dimethyl ammonium chloride.

Suitable cation-active amine softener compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenated-tallow amine; tallow 1,3-propylene diamine; oleyl 1,3-propylene diamine; coconut 1,3-propylene diamine; soya 1,3-propylene diamine and the like.

Other suitable cation-active softener compounds herein are the quaternary imidazolinium salts. Preferred salts are those conforming to the formula

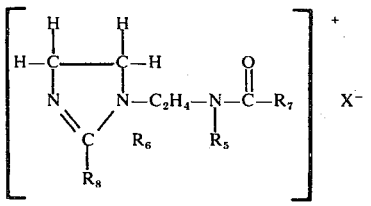

wherein $R_6$ is an alkyl containing from 1 to 4, preferably from 1 to 2, carbon atoms, $R_7$ is an alkyl containing from 1 to 4 carbon atoms or a hydrogen radical, $R_8$ is an alkyl containing from 8 to 22, preferably at least 15, carbon atoms, $R_5$ is hydrogen or an alkyl containing from 8 to 22, preferably at least 15, carbon atoms, and X is an anion, preferably methyl sulfate or chloride ions. Other suitable anions include those disclosed with reference to the cationic quaternary ammonium fabric softeners described hereinbefore. Particularly preferred are those imidazolinium compounds in which both $R_5$ and $R_8$ are alkyls of from 12 to 22 carbon atoms, e.g. 2-heptadecyl-1,1-methyl [(2-stearoylamido)ethyl] imidazolinium methyl sulfate.

Other cationic quaternary anmonium fabric softeners, which are useful herein include, for example alkyl ($C_{12}$ to $C_{22}$)-pyridinium chlorides, alkyl ($C_{12}$ to $C_{22}$)-alkyl ($C_1$ to $C_3$)-morpholinium chlorides, and quaternary derivatives of amino acids and amino esters.

The anionic conditioning agents can include any of the various surface-active anionic fabric-softening and antistatic agents such as alkali metal or ammonium salts of higher fatty alcohol sulfates, higher fatty alcohol ether sulfates, higher fatty alcohol sulfonates, the linear higher alkyl benzene sulfonates, the higher fatty acyl taurides and isethionates. Generally, the cation of such compounds will be an alkali metal or other water-solubilizing radical. The hydrophobic moiety of such compounds will normally contain from 10 to 22 carbon atoms. Alkali metal and ammonium soaps of fatty acids of from 10 to 22 carbon atoms can also be employed and include the sodium or potassium coconut or tallow soaps.

Suitable nonionic fabric softeners and antistatic agents that can be employed are the polyoxyalkylene glycols, the higher fatty alcohol esters of polyoxyalkylene glycols, the higher fatty alcohol ethers of polyoxyalkylene glycols. Also suitable are the ethoxylates of long-chain alcohols of from 8 to 22 carbon atoms such as the ethoxylates of tallow alcohol with, for example, 10 to 40 moles of ethylene oxide. Other nonionics include the amides such as the alkanolamides, e.g., the higher fatty amides and higher fatty acid mono- and di-lower alkanolamides, wherein the long-chain hydrophobic groups have from about 10 to 22 carbon atoms.

Other suitable softening agents include the zwitterionic compounds of the formula

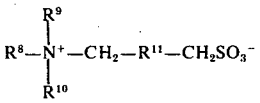

wherein $R_9$ and $R_{10}$ are each methyl, ethyl, n-propyl, isopropyl, 2-hydroxyethyl or 2-hydroxypropyl, $R_8$ is a 12 to 22 carbon atom alkyl or alkenyl and wherein said alkyl or alkenyl contains from 0 to 2 hydroxyl substituents, from 0 to 5 ether linkages, and from 0 to 1 amide linkage, and $R_{11}$ is an alkylene group containing from 1 to 4 carbon atoms with from 0 to 1 hydroxyl substituents; particularly preferred are compounds wherein $R_8$ is a carbon chain containing from 14 to 18 carbon atoms selected from the group consisting of alkyls and alkenyls and wherein said alkyls and alkenyls contain 0 to 2 hydroxyl substituents. Specific examples of the particularly preferred compounds of this class include the following: 3-(N-hexadecyl-N,N-dimethylammonio)-2-hydroxypropane-1-sulfonate; and 3-(N-octadecyl-N,N-dimethylammonio)-propane-1-sulfonate.

Other examples of conditioning agents suitable for the articles herein are described in detail in U.S. Pat. No. 3,686,025 at column 5, line 51 to column 14, line 6, which disclosure is incorporated herein by reference.

The amount of conditioning agent carried by the substrate is an amount sufficient to provide the desired conditioning effect without substantial excess. The amount will vary in any given case and will depend, for example, upon the nature of the particular conditioning agent or substrate material and the type of conditioning effect desired. When the conditioning agent is a fabric softening agent, such agent will preferably be employed in a weight ratio of agent to untreated substrate of from 1:1 to 4:1 or more. Generally, the amount of softener will range from about 2 grams to about 37 grams per foot length of a substrate no more than 11 inches wide, with small amounts of softener being used on lightweight substrates, such as non-woven cloths, and large amounts on heavy substrates, such as multi-ply paper.

The fabric-conditioning articles of the invention can be prepared by employing a number of coating or impregnating techniques known in the art. The relationship between conditioning agent and web substrate is a physical one and for this reason one method will be more suited than another and will depend upon the type of article desired or the nature of conditioning agent or substrate employed. Suitable articles can be prepared, for example, by padding techniques whereby a web is passed through a solution or dispersion of conditioning agent, the excess is removed and the article is allowed to dry. Similarly, the conditioning agent can be sprayed in known manner to provide a similar article. Hot-melt application of a normally-solid fabric softener, for example, can be employed to provide a waxy coated article suited for softening tumbling fabrics. The precise method by which a conditioning article of the invention is prepared should not, however, be considered as limiting the present invention which is directed to certain structural modifications of such conditioning articles to provide laundry dryer compatibility. Examples of fabric conditioning articles suited for such modification and of methods of preparing them are provided in considerable detail in U.S. Pat.

Nos. 3,442,692, 3,632,396 and 3,686,025, incorporated herein by reference.

The fabric conditioning articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about five to 50 volume changes of drying gas in the dryer drum per minute and the air moves at about 125 to 175 cubic feet per minute. These changing volumes of air create a drawing or suction effect which can, especially in small loads, cause a fabric, such as a sock, handkerchief or the like, or a fabric-conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric conditioning article is caused to be disposed in relation to the air exhaust outlet in such a manner as to permit blockage of passing air, undesirable temperature increases can result. This can occur in the case of the employment of fabric-softening articles prepared from normally-solid or waxy softener agents which soften or melt under conditions of heat and which, therefore, may tend to adhere to an exhaust outlet.

The perforations or openings are provided in the fabric-conditioning articles of the invention for two principal purposes. Importantly, the perforations permit passage of air in the event the article is placed in a blocking relationship to the air exhaust outlet. Moreover, the perforations provide a degree of flexibility or resiliency causing the article to crumple or pucker. The effect of such crumpling is that only a portion of the air exhaust outlet will be covered by the conditioning article in the event it is carried by the moving air stream to the exhaust outlet. Moreover, the crumpled article is more readily removed by tumbling fabrics than would be the case if the article were placed in a flat relationship to the exhaust outlet.

The type and number of perforations employed in a fabric-conditioning article can vary considerably and will depend upon the nature of the substrate material, its inherent porosity, flexibility or rigidity, the nature of the conditioning agent carried therein or thereon, and the extent to which increased passage of air therethrough is desired. The articles of the invention can comprise a large number of small perforations of various type or configuration or fewer larger perforations.

As used herein, the terms perforation or opening are employed to designate any type of opening or open space in a fabric-conditioning article through which air can pass in a laundry dryer. The perforations can be regular or irregular in shape and define an area of open space which permits passage of air therethrough when placed in a form-retaining relationship to an exhaust outlet of a laundry dryer. The regular or irregular perforations can be cut into a fabric-conditioning as with a die or other cutting device or be the result of the porosity or air-permeability of the particular substrate material employed in its manufacture.

According to a preferred embodiment of the invention, a sheet of fabric-conditioning article is provided with a plurality of regularly-shaped, e.g. circular, perforations uniformly arranged in the sheet article. Generally, the perforations will provide the article with an open area corresponding to from about 0.5% to about 75% of the area of the sheet. Below about 0.5% open area, the tendency for air to pass through the article is reduced. An open area greater than about 75% reduces the amount of surface area available for fabric-conditioning purposes.

The perforations permit the passage of air therethrough and provide the article with a degree of flexibility or pliability that minimizes the probability that such an article will align itself in a flat and blocking relationship to a dryer exhaust outlet. The inherent puckering or crumpling tendency of the article allows the article to contact the air outlet in such a manner as to leave at least a portion of the air exhaust outlet uncovered. In addition, the tumbling fabrics in the dryer will collide with the crumpled article causing it to be removed from the exhaust outlet. Its removal is readily accomplished by reason of the protrusion of the crumpled article which makes it more available for contact with the tumbling load of fabrics in the dryer. Preferably, the perforations will provide an open area of from about 5% to about 40% of the area of the sheet article.

The perforations in the conditioning articles of the invention can be in a variety of configurations and sizes as can be readily appreciated. In some instances, it may be desirable to provide perforations as circles, ellipses, triangles, squares or other geometric configurations. The perforations can be arranged in a continuous or regular or irregular pattern. From an aesthetic standpoint, a continuous pattern of regularly-shaped perforations will be preferred. The perforations can be arranged as spaced rows of perforations or as a plurality of geometrical patterns. For example, an article of the invention can comprise a plurality of squares, circles, triangles or the like, each of which is comprised of a plurality of individual perforations or holes. Other embodiments include small or large stars or crescents, alphabetical or numerical perforations, logograms, marks, floral and other like designs.

In accordance with a preferred embodiment of the invention, a plurality of circular perforations provided in a continuously patterned arrangement will be employed. These circular perforations are desirably employed in a size of from about 0.02 inch to about 4 inches in diameter. A preferred diameter range is from 0.10 to 1.0 inch.

The perforations employed herein can be provided in a number of ways. For example, a die or other cutting device can be employed to cut, punch or otherwise provide perforations in the desired form or configuration, e.g. circles or stars. The perforations can be supplied to the sheet or web of the article prior to or after treatment of the web with a fabric conditioning agent. The perforations can also be irregularly-shaped and the result, for example, of the interfiber spaces of the web substrate from which the article is prepared. A substrate, for example, having a porosity such that air passes through at a rate of 1100 to 1300 cubic feet per minute at one-half inch water pressure can be treated with a conditioning agent to provide an article having, for example, a porosity of from 450 to 900 cubic feet per minute at ½ inch water pressure. While interfiber spaces of the substrate are partially filled, the resulting article retains sufficient porosity or air-permeability to permit desired passage of air and reduced restrictive affect on dryer air flow.

It will be appreciated that the passage of air through an article of the invention will depend upon the number and size of the perforations. The number and size of perforations desirably employed can be determined on the basis of trial and error. Obviously, only a few small holes will not likely permit a substantial increase in the amount of air capable of passing through the article. Accordingly, the number of perforations will be determined by the extent to which such increase of air passage is desired. Preferably, a fabric conditioning article of the invention will contain a sufficient number of perforations as to permit the passage of at least about 75% of the normal volume of air flow of the laundry dryer. This permits fabrics to be dried efficiently without undesirable temperature build-up or alternate on/-off cycling of the heater and resulting rise and fall of dryer temperature. Normal operating temperatures are adhered to and extended drying times are thereby avoided. Preferably, an article will have a sufficient number of perforabions as to allow at least 85% of the volume of air to pass through the dryer.

The fabric conditioning articles of the invention are simple to employ and normally will be employed in a laundry dryer which is operated at a temperature, for example, of from 75°F to 210°F and for a drying period of from about 5 to 60 minutes. A load of fabrics to be dried is placed into the dryer and a sheet, such as may be detached by tearing from a perforated roll, is simply added to the dryer which is operated in usual fashion. The treated fabrics are then removed and handled in customary fashion.

The following Examples illustrate certain preferred embodiments of the invention and are not intended as limiting the invention. The quaternary ammonium fabric softening agent of Example I – III was di tallow dimethyl ammonium chloride. Other of the various fabric conditioning agents described hereinbefore in detail can be employed to advantage.

EXAMPLE I

A sheet of non-woven cloth substrate (9 × 11 inches) carrying a quaternary ammonium fabric-softening was provided with a plurality of perforations as follows. A circular cutting tool providing circular holes of 0.25 inch diameter was employed to provide several rows of such evenly-spaced holes. Each hole was spaced such that the centers of adjacent holes were one-half inch apart. Holes of 0.13 inch diameter were placed between the rows of 0.25 inch holes such that each 0.13 inch hole was the center hole of a quincunx pattern. Collectively, the holes of both sizes provided an open area amounting to 18% of the area of the sheet.

The resulting article of the invention was evaluated for its potential to minimize interference with dryer air flow by observing its tendency to stick or otherwise adhere to the the exhaust outlet of a laundry dryer by tumbling the article in a fabric load purposely designed to maximize the probability of a tumbling article of being drawn to an exhaust outlet. Each load, of 0.6 lb. dry weight, was comprised of two pillowcases and the fabric-conditioning article. The laundry dryer, a "Kenmore 800" automatic, electric home clothes dryer, was operated in a conventional manner for a 15-minute cycle. Each fabric-conditioning article was tumbled with the pillowcases and was observed for its tendency to become attached to the perforated rear-wall exhaust outlet. The number of times that the article adhered to the outlet for a 20-second duration was recorded. A control article having no holes was evaluated in the same manner for purposes of comparison. The following results were obtained.

TABLE I

| Article | No. of 20-second contacts |
|---|---|
| Control Article with No Holes | 13 |
| Article with Holes | 0 |

EXAMPLE II

A sheet of non-woven cloth (9 × 11 inches) carrying a quaternary ammonium fabric-softening agent was provided with evenly-spaced rows of holes, each 0.25 inch in diameter. Each hole was placed such that the distance between the centers of adjacent holes was 0.5 inch. The open area of the holes amounted to 13% of the area of the sheet.

The article of EXAMPLE II was evaluated in the same manner as that of EXAMPLE I with the following results:

TABLE II

| Article | Number of 20-second contacts |
|---|---|
| Control Article with No Holes | 13 |
| Article with Holes | 1 |

EXAMPLE III

Two nonwoven rayon substrates of different air permeabilities are treated with fabric conditioning agent and compared for their ability to pass circulating air through a commercial automatic dryer. The substrates are treated by impregnating them with a blend of 82% di(hydrogenated tallow) dimethyl ammonium chloride; 12% condensation product of about 9 moles of ethylene oxide with a secondary fatty alcohol of about 13 carbon atoms and 6% of a mixture of volatile materials (water, isopropanol and perfume). Impregnation is carried out by the process described in the commonly assigned, copending U.S. Pat. Application of R. J. Kissner, having Ser. No. 255,664, filed May 22, 1972, now abandoned.

The two substrates have the characteristics shown in Table III.

TABLE III

| | Substrate No. 1 | Substrate No. 2 |
|---|---|---|
| Rayon fiber diameter | 3 denier | 1½ denier |
| Basis Weight (before treatment) | 20 gm/yd² | 20 gm/yd² |
| Basis Weight (after treatment) | 75 gm/yd² | 75 gm/yd² |
| Air permeability* (before treatment) | 1050 cfm/ft² | 700 cfm/ft² |
| Air permeability* (after treatment) | 170 cfm/ft² | 60 cfm/ft² |

*"Air permeability" is measured by the Frazier method as follows: Air is passed perpendicularly through a sample of the test material at a flow rate adjusted to result in a pressure drop of ½ inch of water across the sample. The volumetric air TABLE III-continued

| | Substrate No. 1 | Substrate No. 2 |
|---|---|---|

flow under these conditions is measured. Permeabilities are reported in cubic feet per minute per square foot of material tested. (cfm/ft²)

Sheets of Substrates Nos. 1 and 2, as described in Table III, measuring 9 × 11 inches are manually placed on the exhaust vent of an empty "Kenmore 800" electric dryer so as to completely cover all of the vent openings. Average air flow measurements (taken at room temperature) through the dryer in cubic feet per minute are as follows:

| | |
|---|---|
| No sheet | 105 cfm |
| Substrate No. 1 | 75 cfm |
| Substrate No. 2 | 47 cfm |

During normal use of the product in the dryer, sheet permeability increases as the fabric conditioning material impregnated on the sheet is transferred to fabric load. In an experiment with the Substrates described in Table III, 9 × 11 inch sheets are tumbled in a "Kenmore 800" dryer (operating with normal heating) with a fabric load consisting of six pillow cases for 15 minutes. The sheet was then manually placed across the exhaust vent, as above, and the following airflow measurements observed:

| | |
|---|---|
| Substrate No. 1 | 86 cfm |
| Substrate No. 2 | 62 cfm |

It can be seen that drier air flow is markedly improved as air permeability of the impregnated substrates is increased.

Again sheets measuring 9 × 11 inches of the above-described substrates are tested in "Kenmore 800" electric dryers with a very small load (two pillowcases) designed to emphasize any tendencies of the products to impair dryer air flow. Running time is 15 min. The test loads are observed continuously and records are kept of the time spent by the product sheets on the exhaust vent.

Results of these observations are shown in Table IV.

TABLE IV

| | Substrate No. 1 | Substrate No. 2 |
|---|---|---|
| Number of trials | 3 | 3 |
| Avg. % of running time product was on exhaust vent | 44 | 92 |
| Incidence of sheet on vent at end of run | 1/3 | 3/3 |

This experiment demonstrates that the greater permeability of Substrate No. 1 reduces its tendency to be attracted and held on the exhaust vent.

What is claimed is:

1. A fabric conditioning article comprising a flexible web substrate carrying a non-soap fabric-conditioning agent removable to fabrics by contact therewith in a laundry dryer, said web substrate containing perforations sufficient in size and number as to permit at least about 75% of the normal volume of air flow through said dryer when said article is used therein; said perforations comprising from about 0.5% to about 75% of the area of said web substrate.

2. The article of claim 1 wherein the perforations comprise a plurality of circular holes.

3. The article of claim 2 wherein the holes have a diameter of from about 0.02 inch to about four inches.

4. The article of claim 3 wherein the holes are in evenly-spaced rows.

5. The article of claim 1 wherein the perforations comprise from about 5% to about 40% of the area of the article.

* * * * *

UNITED STATES PATENT OFFICE

CERTIFICATE OF CORRECTION

PATENT NO. : 3,956,556

DATED : May 11, 1976

INVENTOR(S) : Agnes R. McQueary

It is certified that error appears in the above-identified patent and that said Letters Patent are hereby corrected as shown below:

On the title page at [*] after "to" delete "Mar. 4, 1992" and put in its place -- Mar. 16, 1993 --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*